US006354514B1

(12) United States Patent
Henricson et al.

(10) Patent No.: US 6,354,514 B1
(45) Date of Patent: Mar. 12, 2002

(54) METHOD AND APPARATUS FOR TREATING MATERIAL HAVING POOR THERMAL CONDUCTIVITY

(75) Inventors: Kaj Henricson, Helsinki; Kari Peltonen, Karhula, both of (FI)

(73) Assignee: Andritz-Ahlstrom Oy, Helsinki (FI)

( * ) Notice: Subject to any disclaimer, the term of this patent is extended or adjusted under 35 U.S.C. 154(b) by 0 days.

(21) Appl. No.: 09/581,486

(22) PCT Filed: Jan. 28, 1999

(86) PCT No.: PCT/FI99/00054

§ 371 Date: Jun. 14, 2000

§ 102(e) Date: Jun. 14, 2000

(87) PCT Pub. No.: WO99/39146

PCT Pub. Date: Aug. 5, 1999

(30) Foreign Application Priority Data

Jan. 30, 1998 (FI) ..... 980217

(51) Int. Cl.[7] ..... B05B 1/24

(52) U.S. Cl. ..... 239/128; 239/75; 239/500; 162/57; 162/56; 165/174; 165/175; 138/38

(58) Field of Search ..... 162/57, 56; 239/75, 239/128, 500; 165/174, 177; 138/38

(56) References Cited

U.S. PATENT DOCUMENTS 4,881,596 A * 11/1989 Bergmann et al. ..... 165/174

FOREIGN PATENT DOCUMENTS

| | | |
|---|---|---|
| EP | 0 275 502 | 7/1988 |
| GB | 2 135 439 a | 8/1984 |
| WO | WO 97/01074 | 1/1997 |

* cited by examiner

*Primary Examiner*—Stanley S. Silverman
*Assistant Examiner*—Mark Halpern
(74) *Attorney, Agent, or Firm*—Nixon & Vanderhye P.C.

(57) ABSTRACT

A method and an apparatus for heating or cooling material having poor thermal conductivity, especially medium-consistency fiber suspensions. The material is directed, substantially as a plug flow, at a velocity below 5 m/s (e.g. 0.1–1 m/s) through an apparatus formed by a flow channel provided with heat exchange surfaces. The flow of the material is throttled at a throttling point by a more than 30% reduction in the cross-sectional area of the channel. After throttling, the material is discharged from the throttling point in such a manner that another portion of the material contacts the heat exchange surfaces.

22 Claims, 2 Drawing Sheets

A–A

B-B

METHOD AND APPARATUS FOR TREATING MATERIAL HAVING POOR THERMAL CONDUCTIVITY

CROSS-REFERENCE TO RELATED APPLICATION

This application is a U.S. national phase of International application no. PCT/ FI99/00054 filed Jan. 28, 1999.

BACKGROUND AND SUMMARY OF THE INVENTION

The present invention relates to a method and apparatus for treating material having poor thermal conductivity. The method and apparatus according to the invention are especially well applicable to heating or cooling of medium-consistency fiber suspensions within wood-processing industry, or in more general terms to treatment of pulp. In particular, the method and apparatus according to the invention are applied to heating pulp having a consistency of 5–20%, preferably 6–16%, or to recovery of heat from the pulp. The method according to the invention is suitable for treating pulp for the bleaching process at a raised temperature, for example. Bleaching processes using high temperatures include for instance oxygen and peroxide bleaching. Naturally, the method and apparatus for the invention are also applicable to recovering heat from the pulp or cooling the pulp.

It is known from the prior art that vapor is used for the above-mentioned purposes, i.e. for heating the pulp for bleaching, whereby the pulp is heated directly with the vapor. A process like this operates in such a way that the pulp is supplied by means of a pump into a vapor feeding device, in which it is possible by feeding vapor directly into the pulp to raise the temperature of the pulp as desired. Subsequent to the mixing of vapor, the pulp is directed into a mixer, by means of which the temperature differences brought about in the mixing process are evened out and the desired bleaching chemical/s is/are mixed into the pulp. From the mixer, the pulp is directed further into a reactor tower, in which the bleaching process itself takes place. In peroxide bleaching, for example, the temperature in the tower is maintained at about 100° C. and the pressure in the lower part of the tower at about 10–8 bar and in the upper part of the tower at about 5–3 bar. The pulp is removed from the tower by means of a removing device into a blow tank, where the vapor still in the pulp is separated from the pulp to the upper part of the blow tank and from which the pulp is removed by means of a pump. The vapor separated to the upper part of the blow tank is guided to a condenser, in which the heat still in the vapor is recovered from the vapor, the result being condensation water.

However, the process described above involves some disadvantages.

Firstly, a large part of the vapor is condensated into the pulp, whereby the consistency of the pulp is no longer the same as it was when exiting from the pump. For example, raising the temperature by 20° C. with direct vapor makes the consistency fall about 0.5%, which in some cases causes obvious problems in the process.

Secondly, the pressure in the vapor feeding device has to be limited to about 9–10 bar, as (depending on the mill conditions) there might not be vapor at a higher pressure available, or at least not in such a way that it could be easily directed to the bleaching plant.

Thirdly, a large combination of a blow tank, a pump and a condenser is required for recovering heat and guiding the pulp to the following process stage.

Fourthly, the highest temperature of the condenser is 100° C., because the pressure is lowered to the outer air pressure.

Fifthly, the condensate water from the condenser is foul, because it contains residues of bleaching chemicals and reaction products of the bleaching.

Sixthly, the high-pressure vapor means costs to the cellulose pulp mill. If there were less need for high-pressure vapor, a corresponding amount of energy could be sold to power plants, for example.

It was believed that all the above-mentioned problems would be solved if it were possible to develop an indirect heat exchanger that would be suitable for use with consistent pulp. In other words, it would be a device that would efficiently be able to both heat and cool consistent pulp having a tendency to flow as a uniform fiber net, i.e. as a so called plug. These so called MC heat exchangers are described at least in FI patent applications 781789, 943001, 945783, 953064, 954185, 955007 as well as in international patent application PCT/FI96/00330 and FI patents 67584 and 78131.

FI patent application 781789 discloses a large number of apparatus arrangements exploiting and applying fluidization of consistent pulp. This 1970's publication is based on the fluidization theory, which has not been further developed until recently. Over the past two decades, it has been discovered that the theory forms a sound basis for further development, but at that time, i.e. at the end of the 1970's, it did not yet lead to any other practical applications than the so called MC pump. In other words, the various objects of use described were at a stage of elementary ideas and have required a great deal of further study in the case of each individual apparatus. Further investigations have, depending on the case, led to the development of the apparatus to a commercial product or the rejection of the idea as unfeasible. The operating idea of the indirect heat exchanger described in the above-mentioned patent application is that the casing of a tubular apparatus is encircled by heat exchange channels, the casing of the apparatus forming the heat exchange surface. Inside the tube, at the location of the heat exchange surfaces, there is a rotor, by means of which the fiber suspension flowing in the tube is fluidized. The idea is that an intense turbulence is able to circulate each pulp particle so dose to the heat exchange surface that the temperature thereof would be able to change in a way depending on whether it is desirable to recover heat from the pulp or to heat the pulp. It is not known to us whether this kind of apparatus has ever been experimented. In the light of contemporary knowledge, it is obvious that the apparatus does work if the flow rate in the tube is sufficiently slow. However, the idea has two weaknesses. Firstly, treating the pulp for a long time by means of a fluidizator inevitably affects the paper technical properties of the pulp, such as the strength or average length of the fibers. Secondly, fluidization consumes such a great deal of energy that a heat exchanger based on the operation of a mechanical fluidizator will never become a product that would be accepted by cellulose pulp mills.

The heat exchanger according to FI patent 78131 is relatively small in size and intended to be positioned for example before the bleaching tower or after it, either to heat pulp or to recover heat from it. The essential thing in the apparatus described in the patent is that on the inlet side of the heat exchange elements, there is a fluidizing device, by means of which the pulp is made flow through the relatively narrow passes of the compact heat exchanger. However, the fluidizator, which is a prerequisite for the operation of the exchanger, is in fact a problem, as it consumes a large amount of energy. Also, the structure is not applicable to a large bleaching tower, the diameter of which would be in the order of 5–10 meters, for example. It is not even imaginable that in such a large tank, the pulp could be fluidized over the whole cross section area thereof, as described in the FI patent. The energy consumption would be enormous, and on the other hand, several fluidizators would have to be used, whereby there would inevitably be problems with structures. An apparent problem is also that since the publication does not present any precise dimensioning instructions for the heat exchanger, the pulp in the heat exchange channels forms a fiber net and the pulp will not be able to discharge from the apparatus, or that it may not be possible to heat the pulp in the apparatus as desired.

The greatest disadvantage of both above-mentioned apparatus is the energy consumption due to the fluidizator that would have to be continuously used in the apparatus. To eliminate the problem, the operation of the apparatus should, at least primarily, be based on the plug flow of the pulp.

FI patent 67584 describes the above-mentioned arrangement applying said plug flow, in which heat exchange surfaces are arranged in connection with the wall of the bleaching tower. In other words, the publication discloses the idea that pulp could be heated or cooled in the bleaching tower. However, the application described in the publication is unfeasible, because it simply does not function. As the consistent pulp rises or falls as a uniform column in a bleaching tower having a diameter of several meters, it would be impossible to heat the whole of the pulp when heating the surface layer. If the intention were to raise the temperature of the pulp in the whole tower by merely raising the surface temperature, the arrangement would only result in enormous temperature differences.

FI patent application 943001 discloses various alternatives for arranging an indirect heat exchanger within the reactor tower. Unlike in the above-mentioned FI patent 67584, the heat exchanger is formed by concentrical annular heat exchange elements arranged inside the reactor tower, into which heat exchange elements the heat exchange medium, preferably vapor, is directed. Each heat exchange element preferably comprises two concentrical cylindrical casings connected to each other by the ends thereof by means of end surfaces. Through a closed annular space, the heat exchange medium flows from the inlet to the outlet, heating simultaneously the casing surfaces as well the pulp gliding along the outer surface thereof. The heat exchange surfaces are connected to each other preferably by the vicinity of the upper edges thereof by means of preferably radial channels, through which the heat exchange medium is led into all annular elements. At the same time, said channels also act as bearers for the heat exchange elements. Preferably, on the opposite side of the tower, the lower edges of the heat exchange elements are connected to each other by means of channels, through which the condensated vapor and the condensate water are led out of the elements and out of the tower.

As one embodiment, said FI patent application shows how the surface of the elements does not, by any means, have to be even but may be bent as well. The intention is to improve the heating of the pulp in the annular flow channels between the elements by causing turbulence in the pulp, which turbulence mixes the pulp particles moving along the surfaces of the elements with the particles moving further in the channels. Furthermore, in one embodiment it is illustrated how the heat exchange elements, the outermost of which is positioned in connection with the wall of the reactor tower, are provided, by the outer surface against the pulp, with either annular ribs parallel with the periphery, or with spiral ribs. The purpose of the ribs is to cause some turbulence in the flowing pulp in order that the pulp heated on the surface of the elements would mix with the pulp flowing further from the surface of the elements, whereby the pulp would be heated more evenly.

It has also been observed in the above-mentioned FI patent application 943001 that by means of turbulence or the like brought about by the ribs arranged on the heat exchange surfaces it is not possible to conduct heat very far from the heat exchange surfaces, but the distance in practice will be 50–200 mm, depending on the intensity of the turbulence and the velocity and consistency of the pulp. According to said patent application, the heat exchange surfaces, i.e. the elements, should consequently be arranged at a distance of 200–250 mm from each other. In practice, this is often impossible, because the flow resistance generated by the heat exchange surfaces would be too intense. As another solution, several heat exchangers may be arranged in the reactor tower one after another in the direction of the flow. The heat exchangers may be arranged for example in such a way that the diameters of the heat exchange elements of a first heat exchanger form a series of 650 mm, 1,150 mm, 1,650 mm, 2,150 mm and so on. The diameter series of a second heat exchanger is correspondingly 400 mm, 900 mm, 1,400 mm, 1,900 mm, 2,400 mm and so on. In other words, from the first heat exchanger, pulp rings are discharged that are 500 mm thick, except at the center thereof. Each of these rings is divided into two parts by means of second heat exchange elements in such a way that the distance of the new division surface from the heated pulp layer, or rather from the surface against the second heat exchange elements, is 250 mm. In other words, the pulp is divided into slices, each of which is heated in turn.

After more thorough investigations into the matter, it was observed that not even the indirect heat exchanger within the tower, which was disclosed in FI patent application 943001, was reliable. It has been noticed, for example, that if many separate annular heat exchange elements are disposed within the tower, there is a great risk that the pulp flow will channel at some points of the tower between the heat exchange elements in such a way that most of the heat exchange surfaces cannot be utilized. In other words, at least in the light of contemporary studies it seems that the heating of pulp by means of several heat exchange rings positioned within each other would not be possible, but the heating ought to be carried out in a separate apparatus of a smaller size.

Furthermore, the experiments carried out show that the pulp layer of 250 mm presented in said publication is far too thick to be heated indirectly. Thereafter, a solution has been sought with reference to treatment of much thinner pulp layers.

In the prior art publication referred to in the following, i.e. in the international patent application PCT/FI 96/00330, the invention is based on determining some mediumconsistency pulp properties not precisely known beforehand with such accuracy that it has become possible to optimize the operation of the apparatus utilizing these properties, so that the apparatus have become industrially useable. Whereas in our earlier patent application 943001 it was believed that heating could be carried out in a pulp layer of about 250 mm, the performed study showed that heat is generated, practically speaking, only at a distance of about 10–30 mm from the surface of the heat exchanger. Further, it was observed in the study that the flow rate of the pulp has to be in the range of 0.01–5 m/s, preferably 0.1–1 m/s, and most preferably 0.1–0.5 m/s. The next observation was that the length of the heat exchange surface in the flow direction of the pulp should be in the order of 10–70 cm in order to heat said pulp layer as effectively as possible. Therefore, a heat exchanger according to the invention comprises a substantially cylindrical flow channel, i.e. a tube, in which there may be a heat exchange channevs arranged at least on part of the periphery thereof, preferably encircling the whole tube. A number of heat exchange elements located preferably on the diameter of the tube are arranged one after another inside the tube. The elements are disposed in the tube in such a way that they divide the pulp plug flowing in the tube into two parts, so that at the length of the whole set of elements the pulp plug becomes divided into equal sectors, for example into 60-degree sectors, forming a star-like figure seen from the direction of the shaft. Preferably, the elements are located closely one after another, so that there will be no substantial changes in the flow cross section when moving from the area of one element to that of another. The heat exchange elements preferably comprises two opposite plates, and there is a channel for heat exchange medium therebetween.

Experiments indicated that the heat exchanger operated as expected. However, the most difficult practical problem turned out to be the complex structure of the heat exchanger, which makes the apparatus unreasonably expensive.

To eliminate the above-menboned problem, among other things, development work was started to design a heat exchanger with a simpler structure. At the same time, the intention was to try out an operating principle that was somewhat different from that of the conventional indirect heat exchangers. Experiments on previous versions of heat exchangers had yielded so much new information about the behavior of medium-consistency pulp in a complete plug flow and in the vicinity thereof that it was now time to try out the heat exchanger in the area of partial plug flow.

Another problem observed in the experiments was that the outer surface of the tube always heats the same pulp. Therefore, a simple method to change the pulp flowing along the tube wall was needed. This is surprisingly easy to carry out by arranging throttling points to the flow. After the throttling point the pulp flows out again onto the inner surface of the tube, but this time it is other pulp particles that are likely to encounter the inner surface of the pipe than those flowing along it before the throttling point. A throttling point required in a method and apparatus according to our invention closes more than 30%, preferably more than 50% of the flow channel, and most preferably more than 70% of the flow channel. Hereby, the flow rate of the pulp in the throttling point is 1.5–2-fold, preferably over threefold compared to a normal tube flow.

The throttling point is preferably slot-like, but also many other forms are applicable, such as a circle, a half-circle, an ellipse, a rectangle and a triangle. The essential thing is that the throttling point changes the pulp flow in such a way that a new layer of pulp encounters the surface of the tube.

The flow rate of the pulp in the flow channel between the throttling points is 0.01–5 m/s, preferably 0.1–1.0 m/s, and more preferably 0.1–0.5 m/s. At the throttling points the flow rate is over 1.5-fold, preferably over threefold. more than 30%, preferably more than 50% of the flow channel, and most preferably more than 70% of the flow channel. Hereby, the flow rate of the pulp in the throttling point is 1.5–2-fold, preferably over threefold compared to a normal tube flow.

The throttling point is preferably slot-like, but also many other forms are applicable, such as a circle, a half-circle, an ellipse, a rectangle and a triangle. The essential thing is that the throttling point changes the pulp flow in such a way that a new layer of pulp encounters the surface of the tube.

The flow rate of the pulp in the flow channel between the throttling points is 0.01–5 m/s, preferably 0.1–1.0 m/s, and more preferably 0.1–0.5 m/s. At the throttling points the flow rate is over 1.5-fold, preferably over threefold.

At the throttling point the pulp is partly mixed, but it is still preferable that after the last throttling point there is a mixer that evens out the temperature differences in the pulp. The mixer may be self-rotating in the flow or provided with a separate operating device. Of course, the mixer may also be used for mixing chemicals into the pulp. The length of the heat exchange surface between the throttling points is greater than 10 cm, usually 10–200 cm, preferably about 10–70 cm.

GB-A-2 135 439 discusses a heat exchanger for lubricating oils. The heat exchanger is formed of a lengthy pipe being divided into sections by internal baffle elements. The baffle elements are shaped so that they are able to exchange the laminar boundary layer flowing along the pipewall with the stream flowing in the middle of the pipe. The operation of the elements is based on allowing a thin boundary layer flowing as a first flow along the pipewall to flow beneath a first baffle element whereas the rest of the flow so called second flow is guided by means of said first baffle element to the center of the pipe. The first flow is, then, directed sharply towards the center of the pipe by means of a second baffle element arranged perpendicular to the pipewall. The purpose of the second baffle element is to force the first flow through the second flow to the center of the pipe whereas the second flow from the center would, then, form a new boundary layer.

Characterizng features of an apparatus eliminating the above-mentioned problems of the prior art and attaining the above-mentioned purposes of the invention become apparent from the appended claims.

It is characterizing to one preferred embodiment of the method and apparatus for heating and cooling pulp by means of indirect heat exchange surfaces according to the invention that the pulp is allowed to flow in a closed flow channel at a consistency of 5–20%, preferably 8–15%. Hereby, the flow channel comprises at least two throttling points, in which the flow rate of the pulp rises at least 50%, preferably 100%, and even more preferably 150%. Between the throttling points and before the first throttling point there is a heat exchange surface in the surface of the flow channel, the length of which heat exchange surface is more than 10 cm but less than 500 cm, preferably less than 100 cm, In addition to the throttling points there may be other changes made to the pipe to change the geometry of the pipe, usually for increasing the heating surface area. Thus there may be, before the throttling point, a pipe extension or a change from round pipe to, for example, rectangular pipe. Also inside walls or dividing walls etc. may be inserted before or after a throttling point.

The present invention is a result of a long-term series of experiments studying the behavior of the medium-consistent pulp; the experiments have deepened the understanding in the field to such an extent that it has become possible to develop apparatus that no one would have believed could operate only a few years ago. An example of the studies is a heat exchanger, in which medium-consistency pulp can be heated or cooled completely without a fluidizing apparatus, if desired. What makes the invention especially significant is that the apparatus is applicable to almost countless objects of use in a cellulose pulp mill.

Some of the advantages of the method and apparatus according to the invention were theoretically achievable already with the apparatus of the above-mentioned FI patent application 943001, but in this context it is especially worth mentioning that

- the consistency of the pulp does not change when heating the pulp,
- the condensation water remains pure and can be recycled,
- neither the pressure in the reactor nor the temperature of the condenser needs to be limited according to the requirements of the vapor,
- there is no need for a large blow tower-pump-condensator combination,
- the pressure of the pulp in the reactor tower may be used to feed the pulp to the following process stage, for example into a washer,
- low-pressure vapor may be used for heating the pulp; such vapor is normally classified as waste in cellulose pulp mills, so that its removal and condensation have to be arranged in any case. By utilizing the amount of heat present in the low-pressure vapor by means of an indirect heat exchanger according to our invention it becomes possible to sell a larger part of the energy produced by the mill,
- the apparatus has a spacious and simple structure,
- the large inner surface of the tube functions as a heat exchange element, and
- there being only one flow channel, the pulp flow in the apparatus does not channel but proceeds uniformly through the apparatus.

One of the advantages that could also be mentioned is that the inner surface of the flow channel acts as a primary heat exchange surface, the inner surface being always relatively large. When the channel is circular, the following areas are achieved, presuming that the distance between the throttlings is 0.5 meter. With one throttling, the heat exchange surface area of the tube preceding the throttling point is ¶*D*L=¶*1*0.5=1.5 $m^2$ and the heat exchange surface area following the throttling point is the same, i.e. 3 $m^2$ altogether. Correspondingly, with two throttling points, there is 3+1.5=4.5 of heat exchange surface and with three throttling points 4.5+1.5=6 $m^2$. Thus, with five throttlings, a heat exchange surface area of 9 $m^2$ is achieved. Areas such as these are sufficient for raising the temperature of the pulp by more than 5° C., preferably by more than 10° C. It is typical of the method of the apparatus that the change in the temperature is less than 50° C., preferably less than 20° C., sometimes even less than 10° C.

Further, it is characterizing to the apparatus according to one embodiment of the invention that the diameter of the flow channel is more than 0.5 m, preferably more than 1.0 m, but less than 3 m, and preferably less than 1.5 m.

BRIEF DESCRIPTION OF THE DRAWINGS

In the following, the method and apparatus according to the invention are described in more detail with reference to the attached figures, of which

DETAILED DESCRIPTION OF THE DRAWINGS

Figure 1:
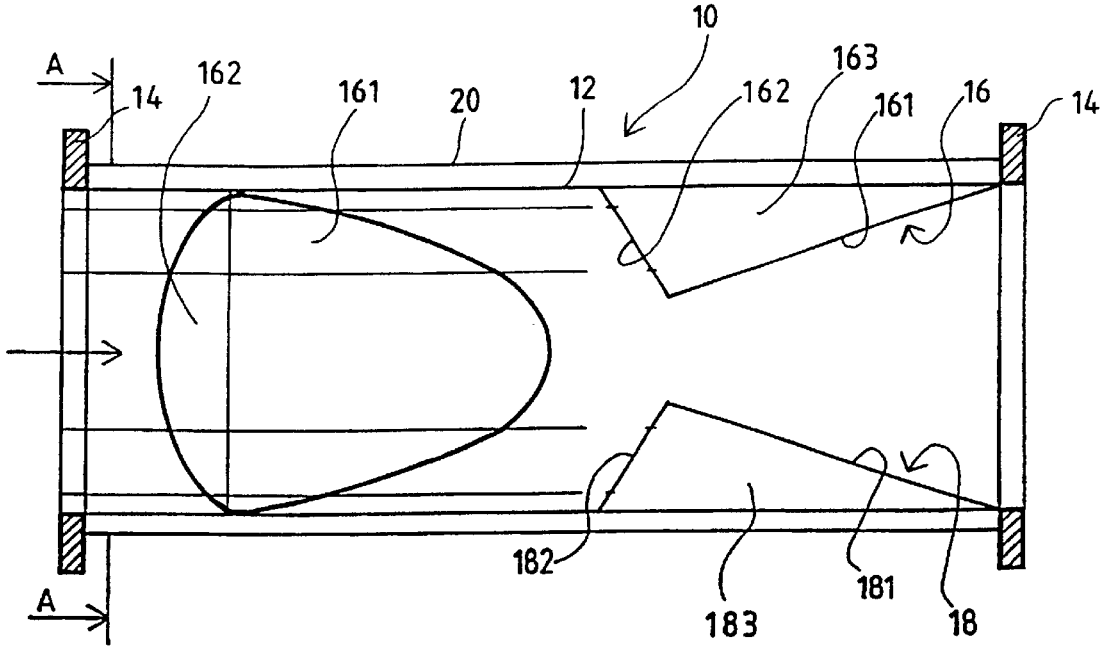
FIG. 1 illustrates an apparatus according to one preferred embodiment of the invention as an axial section.
Figure 2:
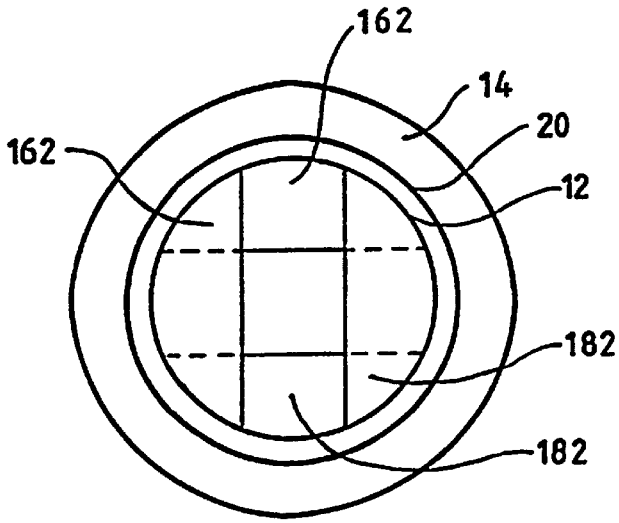
FIG. 2 illustrates an apparatus according to FIG. 1 as a section A—A.

An apparatus 10 shown in FIGS. 1 and 2 according to a preferred embodiment of the invention for treating material that has poor thermal conductivity, i.e. for heating or cooling the material, comprises a tube 12 preferably having a circular diameter, which tube is provided by the ends thereof with flanges 14 to attach the apparatus 10 to a tube line or the like. Inside said tube 12 there are two heat exchange elements 16 and 18 arranged on the opposite sides of the tube, which heat exchange elements throttle the cross sectional area of the tube one-dimensionally. Said heat exchange elements 16 and 18 are preferably identical, being preferably formed of plate material bent in a desired form. In the embodiment of FIGS. 1 and 2, said heat exchange elements 16 and 18 are cut into such a form that the surfaces 161, 162, 181 and 182 thereof remain as planes when the heat exchange elements have been attached inside the tube 12. Between the heat exchange element 16 and the tube 12 there is a vapor space 163. Likewise, there is a vapor space 183 between the heat exchange element 18 and the tube 12. The heat exchange elements 16 and 18 are dimensioned in such a way that there remains an opening of an even width between the elements in the middle part of the tube, the cross section of which is substantially rectangular, the cross sectional area being about 30–70% of the whole cross sectional area of the tube.

In the embodiment of FIGS. 1 and 2, two pairs of heat exchange elements 16, 18 are arranged inside the tube one after another in such a way that the openings between the pairs are perpendicular relative to each other. Outside the tube 12, at a distance from the tube 12, there is preferably, although not necessarily, a heat-insulated casing 20, arranged in such a way that there is a vapor space between the tube 12 and the casing 20. Hereby, the whole area of the tube may be used for heating pulp and for recovering heat from pulp. The vapor is led into the inside spaces 163 and 183 of the heat exchange elements 16 and 18 preferably from the vapor space encircling the tube. Correspondingly, the recovery of the condensate may be arranged either together from the condensate removal from the vapor space of the tube, or if desired, along separate conduits.

The apparatus according to FIGS. 1 and 2 operates in such a way that medium-consistency fiber suspension to be treated is supplied into the apparatus 10 from the left (FIG. 1). The flow rate of the pulp in the apparatus is below 5 m/s, preferably below 1 m/s, most preferably 0.1–1.0 m/s. As the pulp proceeds as a plug inside the tube 12, the plug bumps against the surfaces 162 and 182. Due to the pressure of the pulp coming into the apparatus, the plug flow breaks up at the location of the surfaces, whereby the pulp discharges through the opening between the surfaces in a turbulent state. Hereby, having glided along the surfaces 162 and 182 and having been heated on the surfaces, the pulp breaks up into particles, which are mixed with the pulp flow discharging through the opening between the heat exchange elements 16 and 18. Corresponding mixing takes place also in the opposite direction. In other words, the pulp having flown in the middle part of the tube 12 breaks up into particles in the opening between the heat exchange elements 16 and 18 and mixes into the pulp so that part of said particles drift against the surfaces 161 and 181, whereby also these particles will be heated. When the pulp proceeds in the tube 12 and the flow cross sectional area increases at the location of the surfaces 161 and 181, the pulp forms a new plug flow, whereby the above-described operation is repeated at the location of the following pair of heat exchange elements 16 and 18. Now however, as the heat exchange elements 16 and 18 are disposed, as seen from the end of the tube 12 (FIG. 2), in a perpendicular position relative to the preceding pair of heat exchange elements, it is ensured that the pulp flowing in the tube becomes mixed along the length of the apparatus. Hereby, the major part of the flow will at some phase be in contact with the heat exchange surfaces.

Figure 3:
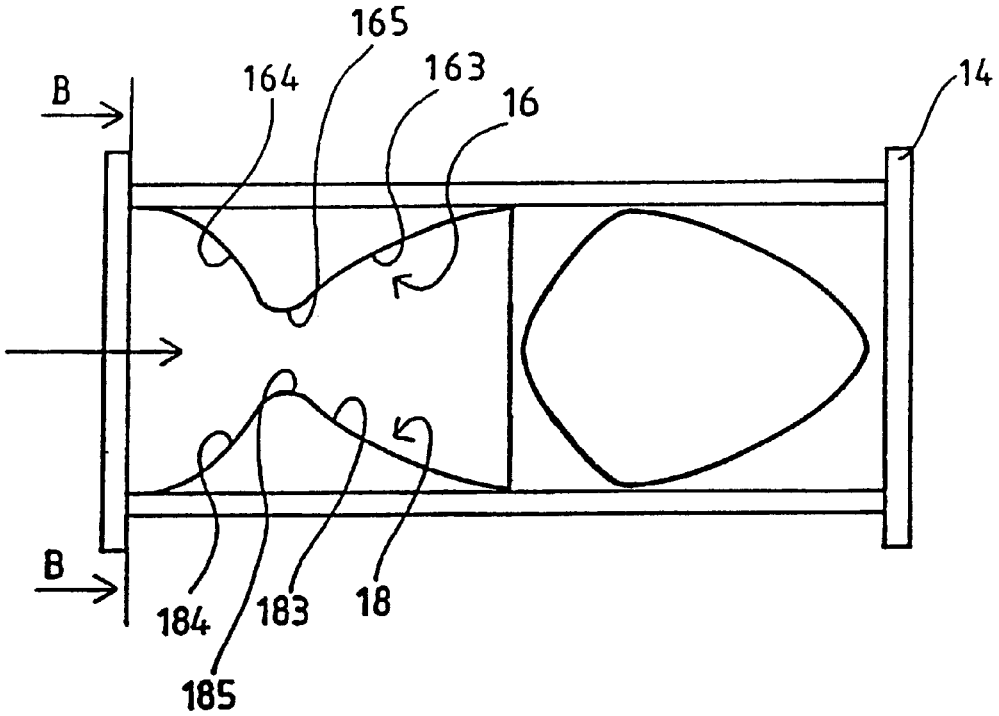
FIG. 3 illustrates an apparatus according to another preferred embodiment of the invention as an axial section.
Figure 4:
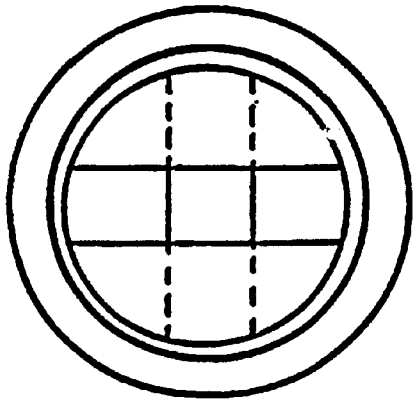
FIG. 4 illustrates an apparatus according to FIG. 3 as a section B—B.

FIGS. 3 and 4 illustrate an apparatus according to another preferred embodiment of the invention. The main structure of the apparatus is as in the embodiment of the FIGS. 1 and 2. The only significant difference is that the surfaces 16 and 18 of the heat exchange elements are curved one-dimensionally. In other words, the end view of the apparatus illustrated in FIG. 4 is similar to that in the embodiment of FIG. 2, i.e. the opening between the heat exchange elements is substantially rectangular, the plane forming the surface of the heat exchange elements 16 and 18 has been bent one-dimensionally only. The heat exchange elements 16 and 18 comprise in this embodiment, as seen from the incoming direction of the flow, concave surfaces 164 and 184, convex surfaces 165 and 185, between which a flow opening is formed, and concave surfaces 163 and 183. Bending the surfaces has mostly to do with the strength of materials; bent surfaces have a better tolerance of the stress the apparatus is subjected to, i.e. pressure and temperature variations.

In addition to the above-mentioned structural arrangements, which are the most preferable from the point of view of manufacturing technique and in which the pairs of heat exchange elements comprise a plate that only requires bending and cutting into an appropriate form, there are naturally other structural solutions, in which a three-dimensional object is formed of the plate material. In fact, FIG. 3 is a relatively good illustration of the form of heat exchange elements also in the case of a three-dimensional plate. In other words, an object resembling a half-circle to some extent is pressed from the plate (corresponding to the plates 164 and 184 of the heat exchange elements), in the middle of which an opening of a desired size is opened. In the same way, a three-dimensional plate corresponding to the plates 163 and 183 of the heat exchange elements is produced, and an opening of a desired size is likewise opened in the middle of the plate. The objects produced in this way are attached to each other either directly by the edge of the opening in the middle, or by means of a connecting means. Naturally, the form of the opening in the middle may be different from the presumed annular opening; it can be an ellipse or even a polygon, for example.

Above, a tube is described as a means having a heatable casing, inside of which two pairs of heat exchange elements are arranged one after another and at an angle of 90 degrees relative to each other, but other kinds of structures are also possible. At its simplest form, the apparatus is formed by a cylinder tube provided with end flanges, inside of which cylinder tube there is one pair of heat exchangers. By attaching a sufficient number of these kinds of devices one after another and taking into account the transition, i.e. the varying angular setting to be arranged between the heat exchange members in apparatus arranged one after another, it is possible to heat pulp at a desired temperature. Naturally, the next complex solution would involve adding heat insulation upon the cylinder tube, and in the next version it would be possible to arrange a possibility for heating, i.e. a vapor casing, between the tube and the heat insulator. Further, it is possible to construct an apparatus with three pairs of heat exchange elements. In such a case, it is preferable to arrange the angular difference between the heat exchange elements to be 60 degrees.

In the apparatus according to our invention, the throttling point used in the apparatus is slot-like, but many other forms are also applicable, such as a circle, a half-circle, an ellipse, a rectangle or a triangle. The essential thing is that the throttling point changes the pulp flow in such a way that a new layer of pulp encounters the surface of the tube. In the experiments, it has been observed that a suitable flow rate in the flow channel between the throttling points is 0.01–5 m/s, preferably 0.1–1.0 m/s, and more preferably 0.1–0.5 m/s. In the throttling point, the flow rate is 1.5-fold, preferably over 3-fold.

Although the pulp is partly mixed at the throttling points, it is still preferable that after the last throttling point there is a mixer evening out the temperature differences in the pulp. In the apparatus according to our invention, the mixer may be either self-rotating in the flow or provided with a separate operating device. Of course, the mixer may also be used for mixing chemicals into the pulp.

The experiments have shown that the distance between the throttlings of the heat exchange surface is preferably less than 500 cm, preferably less than 100 cm, and more preferably about 10–70 cm. Correspondingly, an appropriate diameter for the flow channel in an apparatus according to a preferred embodiment of the invention is more than 0.5 m, preferably more than 1.0 m, but less than 3 m, preferably less than 1.5 m. With this dimensioning, the channel being circular, the following heat exchange surface areas are achieved at a one-meter tube diameter, presuming that the distance between the throttlings is 0.5 m. With one throttling, the heat exchange surface area of the tube preceding the throttling point is ¶*D*L=¶*1*0.5=1.5 $m^2$, and the heat exchange surface area following the throttling point is the same, i.e. 3 $m^2$ altogether. Correspondingly, with two throttling points there is 3+1.5=4.5 $m^2$ of the heat exchange surface area, and with three throttlings 4.5+1.5=6 $m^2$. Thus, for example, with five throttlings a heat exchange surface area of 9 $m^2$ is achieved. These areas are sufficient to change the temperature of the pulp by over 5° C., even over 10° C. It is typical of the method according to the invention that the change in the temperature is below 50° C., preferably below 20° C., sometimes even less than 100° C.

According to yet another embodiment of the invention the diameter of the flow pipe may, however, be as small as 20 cm in cases where the flow channel has been positioned between two reaction towers or like treatment vessels. Normally, in such cases where the only purpose of the flow channel Is to deliver the pulp to another treatment vessel the diameter varies between 20 and 60 cm.

As can be seen from the above description, it has been possible to develop such an indirect heat exchanger for heating and cooling of pulp that has a very simple structure and is therefore very reliable and preferable. Only a few preferred embodiments of the invention are described above, and it is to be taken into account that many apparatus details may in the final commercial product be significantly different from the above structural arrangements, which are more of a schematic nature.

What is claimed is:

1. A method of heating or cooling a pulp and paper industry fiber suspension having a consistency of 5–20% using a plurality of heat exchange surfaces defining a single flow channel having an inner diameter of between 0.2–3 m, comprising:

a) directing the suspension as a uniform, substantially plug, flow at a flow rate below 5 m/s into the single flow channel so that a first portion of the suspension contacts and gives up heat to, or takes heat from, the heat exchange surfaces;

b) at a first throttling location, throttling the flow of the suspension by causing a more than 30% reduction in the flow channel cross-sectional area, where the cross-sectional area is contiguous;

c) after b) widening the single flow channel so that the suspension is again directed as a uniform, substantially plug, flow at a flow rate below 5 m/s into the single flow channel so that a second portion of the suspension, different than the first portion, contacts and gives up heat to, or takes heat from, the heat exchange surfaces; and d) repeating b) at least once at least one subsequent throttling location downstream of the first location, including a second throttling location spaced about 0.1–2 m from the first location.

2. A method as recited in claim 1 wherein d) is repeated at other throttling locations downstream of the second throttling location, the subsequent throttling locations spaced about 0.1–2 m from the second location or from each other.

3. A method as recited in claim 1 wherein a)–d) are practiced to change the temperature of the fiber suspension between 5–20 degrees C.

4. A method as recited in claim 1 wherein b) is practiced to reduce the dimension of the single flow channel in a first direction, while maintaining the dimension of the flow channel constant in a second direction perpendicular to the first direction.

5. A method as recited in claim 1 wherein b) and d) are practiced to increase the single flow at each of the throttling points by at least 50%.

6. A method as recited in claim 1 wherein a) and c) are practiced so that the uniform, substantially plug, flow of the fiber suspension is at a flow rate between 0.1–1.0 m/s.

7. A method as recited in claim 1 wherein b) and d) are practiced by causing a more than 50% reduction in the flow channel cross-sectional area.

8. A method as recited in claim 1 wherein b) and d) are practiced by causing a more than 70% reduction in the flow channel cross-sectional area.

9. A method as recited in claim 1 wherein a) and c) are practiced utilizing a flow channel that has a diameter between 1–1.5 m.

10. A method as recited in claim 1 wherein d) is practiced so that the throttling locations are spaced between 0.1–0.7 m.

11. Apparatus for heating or cooling a fiber suspension comprising:

a single flow channel having a contiguous cross-sectional area, and an interior diameter of between 0.2–3 m, said single flow channel provided with a plurality of interior heat exchange surfaces, and having a first end and a second end; and at least one throttling location disposed along said single flow channel between said first and second ends thereof, said throttling location causing a more than 30% reduction in the cross-sectional area of said flow channel.

12. Apparatus as recited in claim 11 wherein said at least one throttling location comprises a plurality of throttling locations, said throttling locations spaced from each other along said single flow channel a distance of between 0.1–2 m.

13. Apparatus as recited in claim 11 wherein said at least one throttling location is provided at least in part by said heat exchange surfaces.

14. Apparatus as recited in claim 11 wherein said single flow channel at said at least one throttling location defines a contiguous flow opening that is substantially rectangular, semi-circular, elliptical, or triangular in cross-section.

15. Apparatus as recited in claim 11 wherein said throttling location is defined by two opposite substantially parallel restricting elements.

16. Apparatus as recited in claim 15 wherein said substantially parallel elements comprise plates attached to opposite walls of said flow channel.

17. Apparatus as recited in claim 11 wherein at said throttling location a plate having a curved surface is provided attached onto a wall of said single flow channel.

18. Apparatus as recited in claim 11 wherein at said at least one throttling location there is a more than 70% reduction in the cross-sectional area of said single flow channel.

19. Apparatus as recited in claim 12 wherein at each of said throttling locations there is a more than 50% reduction in the contiguous cross-sectional area of said flow channel, and wherein said throttling locations are spaced from each other along said flow channel a distance of between 0.1–0.7 m.

20. Apparatus as recited in claim 11 wherein said single flow channel comprises a tube having an exterior wall, and a vapor space.

21. Apparatus as recited in claim 19 wherein said flow channel has an interior diameter of between 1–1.5 m.

22. A method of heating or cooling a pulp and paper industry fiber suspension having a consistency of 8–15% using a plurality of heat exchange surfaces defining a single flow channel having an inner diameter of between 0.2–3 m, comprising:

a) directing the suspension as a uniform, substantially plug, flow at a flow rate between 0.1–1.0 m/s into the single flow channel so that a first portion of the suspension contacts and gives up heat to, or takes heat from, the heat exchange surfaces;

b) at least one throttling location, throttling the flow of the suspension by causing a more than 50% reduction in the flow channel contiguous cross-sectional area;

c) after b) widening the flow channel so that the suspension is again directed as a uniform, substantially plug, flow at a flow rate below 5 m/s into the single flow channel so that a second portion of the suspension, different than the first portion, contacts and gives up heat to, or takes heat from, the heat exchange surfaces; and wherein a)–c) are practiced so as to change the temperature of the fiber suspension between 5–20 degrees C.

* * * * *